US005890408A

United States Patent [19]

Bailey

[11] Patent Number: 5,890,408

[45] Date of Patent: Apr. 6, 1999

[54] THREAD REMOVAL APPARATUS FOR USE IN THE MANUFACTURE OF INFUSION PACKETS

[75] Inventor: Thomas William Bailey, Warwick, United Kingdom

[73] Assignee: Thomas J. Lipton Co., Division of Conopco, Inc., Englewood Cliffs, N.J.

[21] Appl. No.: 729,891

[22] Filed: Oct. 15, 1996

Related U.S. Application Data

[63] Continuation of Ser. No. 300,836, Sep. 2, 1994, abandoned.

[30] Foreign Application Priority Data

Sep. 3, 1993 [GB] United Kingdom ..... 9318273

[51] Int. Cl.[6] ..... B26D 7/00

[52] U.S. Cl. ..... 83/100; 83/343; 83/346; 83/909

[58] Field of Search ..... 83/909, 300, 303, 83/100, 346, 343, 404, 109, 154, 302, 407; 53/134.2

[56] References Cited

U.S. PATENT DOCUMENTS

| | | | |
|---|---|---|---|
| 2,836,018 | 5/1958 | Key | 83/303 |
| 3,144,216 | 8/1964 | Billingsley | 83/102 |
| 3,834,291 | 9/1974 | Bishop | 83/103 X |
| 4,549,454 | 10/1985 | Yamashita | 83/300 X |
| 5,135,762 | 8/1992 | Vernon et al. | 53/134.2 X |
| 5,275,075 | 1/1994 | Keech et al. | 83/403 X |
| 5,312,318 | 5/1994 | Vernon et al. | 493/194 |
| 5,399,224 | 3/1995 | Vernon et al. | 53/134.2 X |
| 5,527,419 | 6/1996 | Vernon et al. | 53/134.2 X |
| 5,580,408 | 12/1996 | Vernon et al. | 53/134.2 X |

FOREIGN PATENT DOCUMENTS

| | | |
|---|---|---|
| 0 448 325 | 9/1991 | European Pat. Off. . |
| 448 325 | 9/1991 | European Pat. Off. . |
| 0 489 554 | 6/1992 | European Pat. Off. . |
| 489 554 | 6/1992 | European Pat. Off. . |
| WO 91/13580 | 9/1991 | WIPO . |
| WO 92/06903 | 4/1992 | WIPO . |
| WO 92/14649 | 9/1992 | WIPO . |

*Primary Examiner*—M. Rachuba
*Attorney, Agent, or Firm*—James J. Farrell

[57] ABSTRACT

A web (W) of sheet material intended to form individual tagged packets has surplus portions of a thread (S) extending along its length removed while the web is being advanced. After severing one end of each unwanted thread portion with a rotary cutter (2), the severed end is lifted by a wiper (10), and the lifted end is held away from the web by suction means (20) while it is detached by shearing means (22). The suction means (20) then remove the detached thread portion.

9 Claims, 3 Drawing Sheets

THREAD REMOVAL APPARATUS FOR USE IN THE MANUFACTURE OF INFUSION PACKETS

This is a continuation, application of Ser. No. 08/300,836, filed Sep. 2, 1994, now abandoned.

BACKGROUND OF THE INVENTION

This invention relates to the removal of portions of thread from a length of thread which is attached to a web of sheet material to extend along the length of the web. It is particularly concerned, although not necessarily exclusively so, with such a process as one stage in the production of infusion packets to which tags are attached by a thread.

The use of such tagged packets is well known. European Patent Application EP 448325A, describes a process for producing the packets during which a series of spaced tags are attached to a length of thread and the thread and tags are attached to a web along its length. The procedure by which the tags and thread are assembled with the web is described in more detail in U.S. Pat. No. 5,527,419 to which reference can be made for further details.

What is particularly significant in that assembly procedure in the present context is that it results in a continuous length of thread extending along the web in which only those portions that connect the tags to the web serve a useful purpose. The remaining portions can complicate subsequent stages in the process of producing the packets and can present an awkward appearance in the finished product.

SUMMARY OF THE INVENTION

According to one aspect of the present invention there is provided means for removing portions of thread from a length of thread attached to a web, comprising means for severing one end of each said portion and means for holding said severed end spaced from the web while severing the other end of said portion to detach the portion from the web.

Preferably, mechanical means are provided to lift the severed end of said thread portion away from the web, as for example a wiping or sweeping device. Conveniently suction means are employed to hold the severed end spaced from the web while the second end of said thread portion is severed, the suction means then being employed to remove the detached thread portion.

According to another aspect of the invention, there is provided a method of removing portions of thread from a length of thread attached to a web while the web is being advanced, comprising severing one end of each portion at a first station in the path of the web advance and at a station downstream from said first station holding said severed end spaced from the web while severing the other end of said portion to detach the portion from the web.

The invention will be further described by way of example with reference to the embodiments illustrated in the accompanying drawings.

DESCRIPTION OF THE PREFERRED EMBODIMENTS

Figure 1:
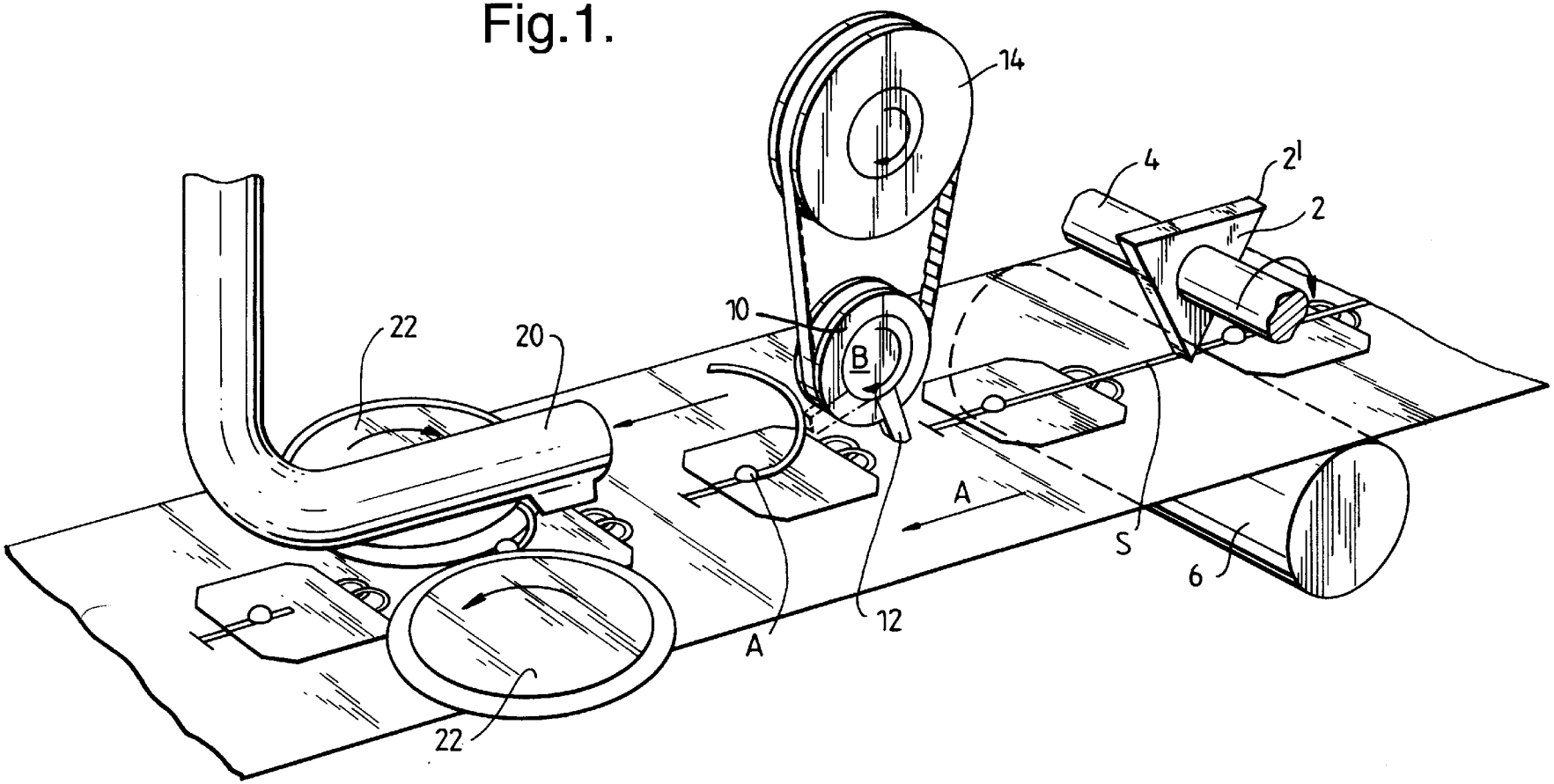
FIG. 1 is a schematic illustration of the thread removing means according to the invention.
Figure 2A:
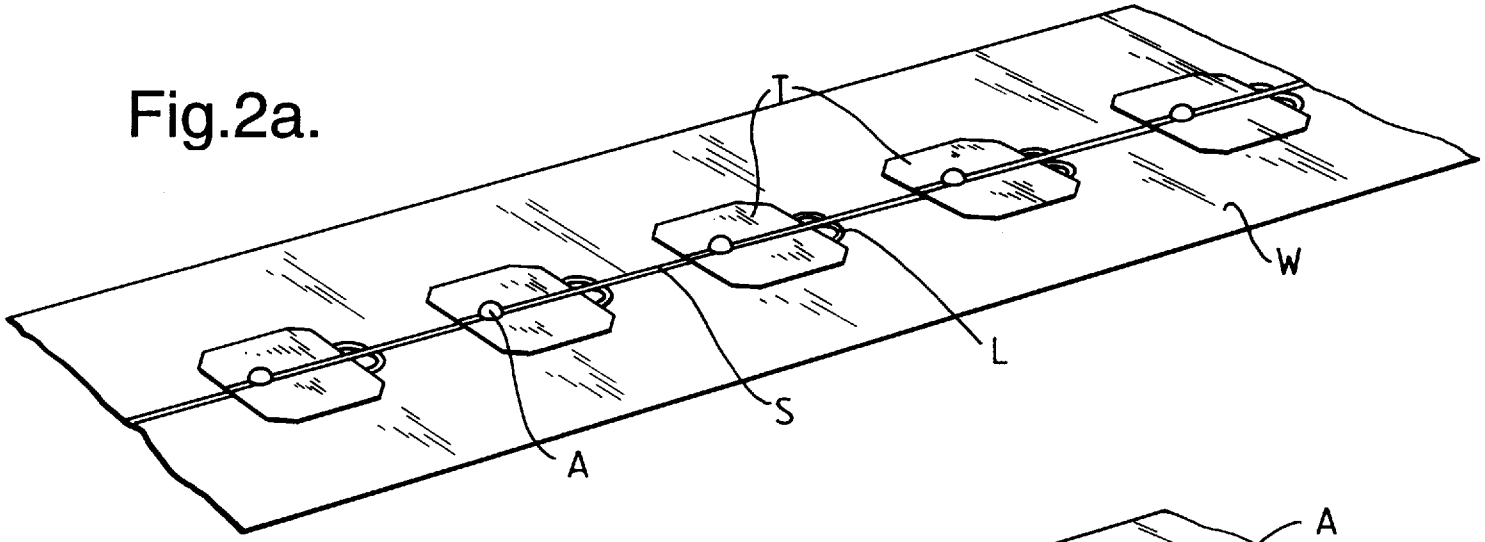
FIGS. 2*a* & 2*b* show the web, thread and tag assembly before and after the operation of the means of FIG. 1.

The illustrated apparatus is so arranged that a continuous web W of sheet material enters the means shown in FIG. 1 travelling along a path in the direction V. After further process steps with which the present invention is concerned and which are described below, the web is eventually heat-sealed and severed at intervals along its length to provide a series of discrete packets, which may themselves take a generally conventional form, eg. as tea bags. As shown in FIG. 2*a*, at this stage a thread S extends along one face of the web W as means (not shown) advance the web through the apparatus. The thread is held in place by tags T which are spaced along the web to provide one tag to each of the packets eventually formed from the web. Tacking heat seals (not shown) attach the tags T releasably to the web and adhesive seals A secure the tags T to the thread. Between the adhesive connections of the thread to the web and the tag of each packet the thread is gathered, eg. in a loop L, and this excess length is held secure under the tag by the attachment of the tags to the webs.

The elongate portions of the thread S, from its adhesive seal A to near the point at which it runs under the following tag T, serve no purpose in the finished packets. While they remain in place they complicate the formation of the transverse seals (not shown) that are eventually formed to define the individual packets and the severing of those packets from each other. It would be desirable to remove these portions first but if the web, thread and tags are assembled together in a continuous process, such as that described in EP 489554, this should be done in a way which does not slow that process. The apparatus now to be described thus operates on the moving assembly of web, thread and tags.

As it enters the illustrated apparatus, the web W passes between a cutting member in the form of a cutter plate 2 mounted on a rotary shaft 4 and a counter-rotating anvil member 6. The counter-rotating cutting and anvil members act as severing means for severing the thread at intervals between successive tags T. The equispaced cutting tips 2' on the periphery of the cutter plate 2 move in the direction of advance of the web as they contact the thread S immediately ahead of each tag T, with pressure from the correspondingly moving opposed region of the anvil member 6, cutting the thread at these points of contact. These cuts by the severing means thus form a first end of each portion of thread to be removed. The web is also cut by the cutting tips 2' but this is not significant because the cuts are co-incident with the ends of the packets eventually.

The web then passes under a rotary wiper 10 from which at least one elastomeric finger 12 projects radially. The wiper acts as a displacement means for the severed thread. It is rotated by a belt drive 14 in the arrowed direction B so that the wiper finger 12 moves in the same direction as the web over the lowest part of its rotary path but at a considerably faster speed. In this lowest portion of its path the finger 12 comes into contact with the thread S towards the rear of the tag T. As it bears on the tag and thread, the finger 12 sweeps the severed end of the thread upwards and forwards.

The displacement of the loose thread end by the wiper finger 12 is reinforced by a suction means comprising a nozzle 20 which acts as holding means to hold the loose thread end away from the web. The suction nozzle 20 has openings (not shown) both in its end facing the rotary wiper 10 and on its underside where it passes over a pair of rotating cutter discs 22 which in this embodiment form detaching means for the unwanted thread portion. At their nip the edges of the disc moves in the same direction as the web but at a faster speed operating as shearing means on the thread. The web passes under the discs but the lifted thread is severed by them at the second end of the portion being detached, close to the attachment A of the thread to the web.

Figure 2B:
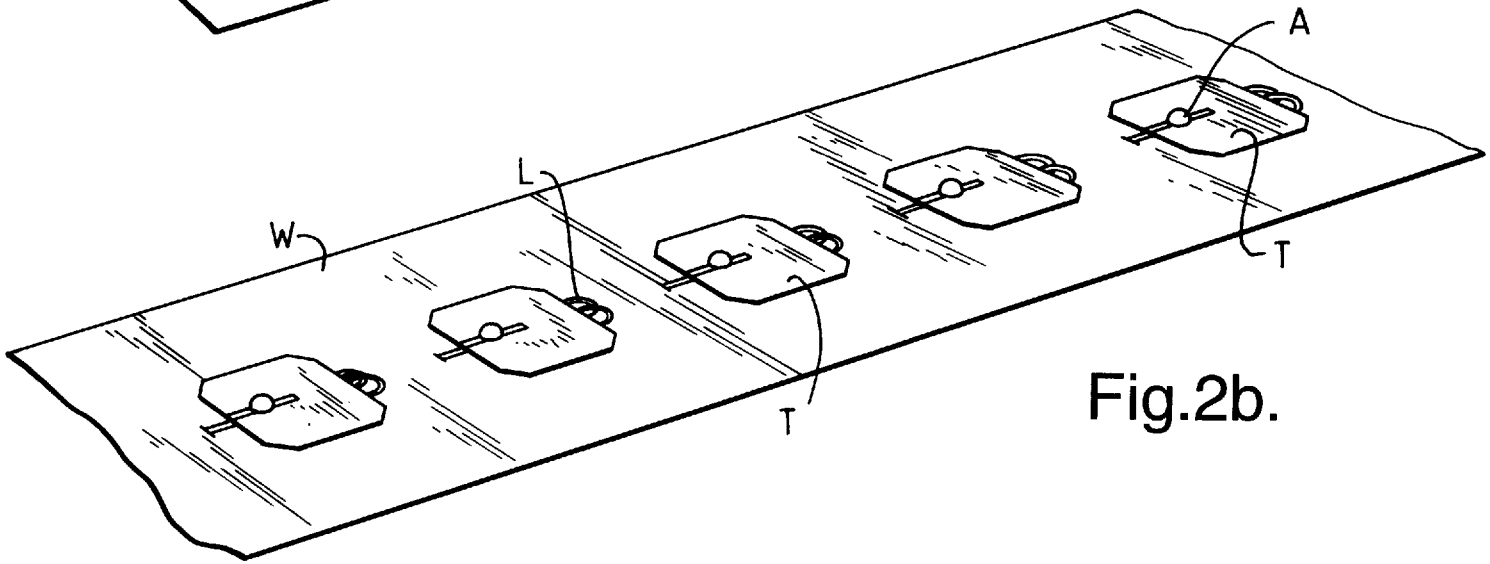

The unwanted thread portion is thereby completely detached at its second end and the suction force removes it, through the nozzle 20, to a waste collection location (not shown) to ensure that it does not interfere with the subsequent packet production process. The assembly of the web thread and tags is now as shown in FIG. 2*b*.

The movements of the cutter plate 2 and the rotary wiper 10 are synchronised with the web movement to register them with the required locations on the thread for their action, but this is not necessary for the cutter discs. Alternative cutting means can be provided, in particular in place of the shear discs slitting means or crush cutting means can be employed.

Figure 3:
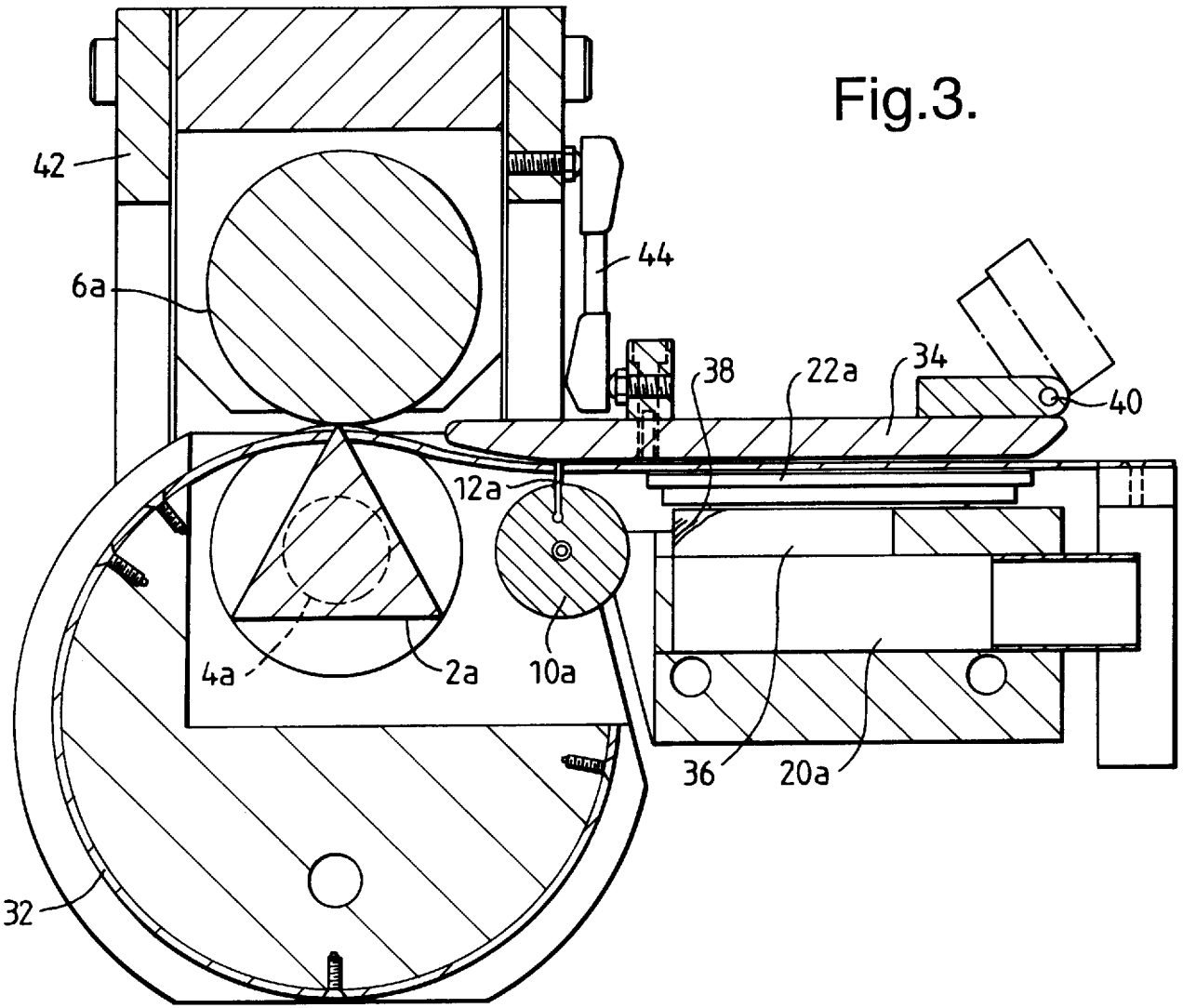
FIG. 3 is a sectional view in a central vertical plane of a modified form of the thread removal means of FIG. 1.

FIG. 3 illustrates another embodiment of the invention with a number of detail features that can be employed in the embodiment of FIG. 1 also. Parts that are essentially the same as those already described with reference to FIG. 1 are indicated by the same reference numbers with the suffix "a ". The web, with its thread and tags, is not shown inFIG. 3 but is identical to that described with reference to FIG. 2*a*.

The embodiment of FIG. 3 also has a cutter plate 2*a* rotating on shaft 4*a* acting against counter-rotating anvil 6*a*, rotary wiper 10*a* with finger 12*a*, rotating cutter discs 22*a* and suction nozzle 20*a*. In this case, the thread (not shown) and tags (not shown) are located on a first face of the web (not shown) that is its underface so that the cutter plate 2*a*, wiper 10*a*, cutter discs 22*a* and suction nozzle 20*a* are disposed below the web path. The cutter plate rotates in a void in a stationary guide cylinder 32 over which the web (not shown) is led. Further along the web path a backing plate 34 is provided for the second face of the web opposite the first face. The backing plate 34 extends over the rotary wiper 12*a* and entry slot 36 of the suction nozzle as a support and location for the web, (not shown) on its path through the apparatus. The stationary cylinder 32 and the backing plate 34 act jointly as fixed support means for the web along their extent between the cutter plate 2*a* and the cutter discs 22*a*. As in the first embodiment, the cutter plate 2*a* and anvil 4*a* act as severing means for a first end of each unwanted thread portion and the cutter discs 22*a*, in severing the second ends, act as detaching means for the thread portions. The fixed support means assist the action of the wiper and the cutter discs 22*a*. The leading end of the slot 36 has flared faces 38 widening the leading end of the slot to ensure that the severed ends of the thread (not shown) are drawn into the slot before the unwanted portions (not shown) are cut free by the discs.

The anvil 6*a* is journalled in a mounting 42 that can be lifted on gas struts (not shown) about a pivot axis (not shown) parallel to the plane of FIG. 3 but behind the anvil to assist threading the web past the slot 36. The backing plate 34 swings about the pivot 40 for the same purpose. A link 44 connects the backing plate 34 to the mounting 42 so that it is lifted simultaneously with the anvil.

In the illustrated examples, the thread is not directly connected to the web but in use a permanent connection will be required between each remaining thread length and the web at the end of the thread length remote from its attachment A to the tag. This further connection can be provided subsequently by heat-sealing means or by adhesive. It is also possible to make the connections before removing the unwanted thread lengths, particularly if adhesive is used for this.

I claim:

1. An apparatus for removing elongate portions of thread from a length of thread attached to a web, said web having a longitudinal direction and the thread being attached to the web at regions spaced from each other along said longitudinal direction, said portions of thread being. at locations between said regions at which the thread is attached to the web, each said portion of the thread comprising a first end and a second end remote from said first end, apparatus comprising adjacent the web for severing the thread to form said first end of each portion of thread, holding means for holding said first end spaced from the web, and detaching means for serving the thread to form said second end of each said portion of thread and thereby to detach said portion of thread from the web.

2. An apparatus according to claim 1 comprising a path along which the web advance, said path extending in the longitudinal direction of the web, the web having a first face and a second face opposite said first face, the thread being attached to said second face, said first and second faces extending in said longitudinal direction, the apparatus comprising fixed support means having an extent in said longitudinal direction of the web and located against said first face of the web to provide support for the web along said path, said serving means and said detaching means being disposed along the extent of said fixed support means to act upon the thread on the second face of the web.

3. An apparatus according to claim 1 comprising suction means for removal of the detached portions of thread.

4. An apparatus according to claim 1 comprising suction means acting as said holding means, said suction means being arranged; adjacent the web to apply a suction for drawing the severed first end away from the web.

5. An apparatus according to claim 4 wherein said suction means comprises a nozzle for removal of the thread portions detached from the web.

6. An apparatus according to claim 1 comprising displacement means for displacing said first end of the thread portion away from the web, after said first end has been severed and before said second end is severed.

7. An apparatus according to claim 1 comprising a path along which the web advance with said lengths of thread attached, and a shearing means disposed in a stationary position relative to said path to act as said detaching means for serving the thread to form each second end, thereby to detach the thread portion from the web.

8. An apparatus according to claim 1 comprising a path along which the web advances with said attached lengths of thread, and wherein the severing means and the detaching means for severing respectively the first and second ends of each thread portion are spaced from each other along said path, said severing means for said first end of each thread portion comprising counter-rotating cutting and anvil members having opposed regions between which said thread is pinched the rotation of, said cutting and anvil members moving said opposed regions in a direction corresponding to the advance of the web along said path while they sever the thread.

9. An apparatus according to claim 4 comprising a path along which the web advances, the web having a first face and a second face opposite said first face, the apparatus further comprising fixed support means for engaging said first face of the web, said fixed support means having an extent along said path, and at least one of the displacement means, the suction means and the detaching means are located within the extent of said fixed support means and over the second face of the web.

* * * * *